United States Patent [19]

Durr, Jr. et al.

[11] Patent Number: 4,758,374

[45] Date of Patent: Jul. 19, 1988

[54] SOLUBLE OIL CONCENTRATE AND EMULSIFIER SYSTEM USED THEREIN

[75] Inventors: Albert M. Durr, Jr.; Bryant J. Hardy, both of Ponca City, Okla.

[73] Assignee: Conoco Inc., Ponca City, Okla.

[21] Appl. No.: 26,509

[22] Filed: Mar. 17, 1987

[51] Int. Cl.[4] ..... B01J 13/00

[52] U.S. Cl. ..... 252/312; 252/355; 252/78.1

[58] Field of Search ..... 252/312, 355, 76, 78.1

[56] References Cited

U.S. PATENT DOCUMENTS

| | | | |
|---|---|---|---|
| 2,307,744 | 1/1943 | Liberthson . | |
| 2,470,913 | 5/1949 | Bjorksten et al. . | |
| 2,670,310 | 2/1954 | Freeman . | |
| 2,695,272 | 11/1954 | King et al. . | |
| 2,846,393 | 8/1958 | Cook et al. . | |
| 2,913,410 | 11/1959 | Fisher . | |
| 3,981,808 | 9/1976 | McClaflin et al. . | |
| 4,243,549 | 1/1981 | Messenger et al. . | |
| 4,360,443 | 11/1982 | Durr, Jr. | 252/75 X |
| 4,414,121 | 11/1983 | Aiello | 252/49.5 |
| 4,419,251 | 12/1983 | Shim et al. | 252/49.5 X |
| 4,428,855 | 1/1984 | Law et al. . | |
| 4,476,037 | 10/1984 | Ploog et al. | 252/355 X |
| 4,485,026 | 11/1984 | Schmitt et al. | 252/87.1 |
| 4,536,300 | 8/1985 | Kayser et al. | 252/8.554 |

*Primary Examiner*—Matthew A. Thexton

*Attorney, Agent, or Firm*—C. R. Schupbach

[57] ABSTRACT

The combination of a conventional emulsifier package for soluble oils and a synergistic combination of (a) an oxazoline derivative and an amide and (b) an ether sulfate ammonium salt surfactant. The oxazoline drivative and amide contain straight or branched chain alcohol and fatty acid substituents. The ether sulfate ammonium salt surfactant contains a mixture of alkyl groups. The combination is incorporated with a base oil to produce soluble oil concentrate.

10 Claims, No Drawings

SOLUBLE OIL CONCENTRATE AND EMULSIFIER SYSTEM USED THEREIN

BACKGROUND AND SUMMARY OF INVENTION

Coal mine operators are continuously seeking soluble oil concentrates which form stable emulsions with water, and more particularly soluble oil concentrates which are capable of forming stable emulsions of a minor part of concentrate and a major part of water, such as are used in roof support jacks in mines. Because of the use to which these emulsions are subjected, which in may cases involves standing static for thirty days or more in a mine roof support jack, the emulsions must have extremely good stability. Such emulsions also have utility as cutting oils for maching operations.

According to the present invention a soluble oil concentrate which forms stable emulsions with water is prepared by combining an emulsifier system with a base oil in which the emulsifier system comprises a conventional emulsifier package for soluble oils and a synergistic amount of (a) a mixture of an oxazoline derivative with straight or branched chain alcohol and fatty acid substituents and an amide with straight or branched chain alcohol and fatty acid substituents and (b) an ether sulfate ammonium salt surfactant containing a mixture of alkyl groups.

PRIOR ART

There are numerous references in the literature describing soluble oil formulations for forming stable emulsions with water, U.S. Pat. Nos. 2,307,744; 2,470,913; 2,670,310; 2.695,272; 2,846,393; and 2,913,410 are representative of references describing emulsifiable oil compositions of the type to which this invention is directed. The compositions described in these prior art patents generally include mineral oil and an emulsifier package comprising an emulsifier, a coupling agent, and various additives. Other prior art references are U.S. Pat. Nos. 4,243,549; 4,428,855; and 3,981,808.

U.S. Pat. No. 4,243,549 discloses a concentrated aqueous surfactant composition containing at least one amphoteric surfactant such as an alkylamine ether sulfate, a quaternized imidazoline, a betaine, etc.

U.S. Pat. No. 4,428,855 describes an emulsifier package containing a co-emulsifier system in addition to the usual emulsifiers. The co-emulsifier system consists of alkanolamines and/or heterocyclic amines or mixtures thereof.

U.S. Pat. No. 3,981,808 discloses an emulsifier package for use in preparing a soluble oil concentrate comprising an emulsifying agent such as mahogany sulfonate, fatty acid, rosin acid, naphthenic acid, alkali metal hydroxide, alkylol amine or alkylene glycol.

DETAILED DESCRIPTION OF THE INVENTION

The compositions formed by the combination of the emulsifier systems of this invention with a base oil are generally referred to as soluble oils, although these compositions ordinarily form an emulsion when mixed with water. In order to distinguish between the soluble oil concentrate and the emulsion which is produced when the concentrate is mixed with sufficient quantities of water, the term "soluble oil concentrate" will be used to describe the oil plus emulsifier, and the emulsion which is formed when the soluble oil concentrate is mixed with water will be referred to as a "soluble oil emulsion". The emulsion which is formed when the soluble oil concentrate is mixed with water is of the oil-in-water type wherein the aqueous phase constitutes the continuous phase and the mineral oil constituent is the dispersed phase.

Compositions of the present invention are primarily designed for use in hydraulic jacks such as those used to support mine roofs. These jacks are normally left in place for long periods of time, and it is important that the soluble oil emulsions used as hydraulic fluid in such jacks be extremely stable. Conventional hydraulic fluids are not acceptable for this use as they present a fire hazard and a disposal problem, whereas the compositions of this invention are mostly water. It is also important that the soluble oil concentrate be capable of forming a stable emulsion with water available at the point of use, and in many cases this means that the concentrate must be capable of forming a stable emulsion with hard water. Both paraffinic and naphthenic base oils may be used in the preparation of soluble oil concentrates. The concentrate comprises about 75 to about 90 percent by weight of the base oil with the balance being the emulsifier system of this invention.

Any of the conventional emulsifier packages for soluble oils may be used in the concentrates of this invention. Although such systems may vary in their specific components they typically include sodium sulfonates, rosin and fatty acids, alkylol amines, alkali metal hydroxides and an alkylene glycol coupling agent. When used in the preparation of soluble oils the conventional emulsifier packages may provide only marginal protection in certain areas, such as rust resistance and emulsion stability in very hard water. The synergistic combinations disclosed herein provide improved emulsifier systems in terms of rust resistance and particularly in the area of emulsion stability.

The sulfonates used in the emulsifier package may be broadly described as organic sulfonates, and a particularly desirable sulfonate which may be employed is the sulfonate derived from treatment and purification of petroleum oil with sulfuric acid. The conventional method of recovering sulfonates as by-products during the refining of petroleum distillates is to dilute the sludge with a hydrocarbon oil. The mahogany acids remain in the resulting oil layer and are separated from the sludge layer which contain the green acids. The oil layer can be washed with aqueous alcoholic solutions which remove the mahogany acids, or it can be treated with alkali and the sulfonic acids recovered with alcohol as mahogany salts. The sludge may be boiled with water and the dilute acid recovered. The supernatant layer may then be neutralized and the residual oil extracted with naphtha or other suitable solvent. The sulfonates thus formed are commonly referred to as mahogany sulfonates, and various salts of such sulfonates such as the alkali metal, alkaline earth, and heavy metal salts thereof may be utilized in conventional emulsifier packages.

The base oils used in the concentrates of this invention include conventionally refined paraffinic and naphthenic base oils, as previously mentioned. Such oils preferably have a viscosity of from 50 to 500 SSU at 100° F., and more preferably about 100 to about 200 SSU at 100° F.

Carboxylic acids which may be employed in the emulsifier package are the fatty, rosin, and naphthenic acids. Suitable fatty acids are the higher fatty acids, both saturated and unsaturated, and particularly those that may be produced or obtained from vegetable and animal glycerides. They may be used as individual fatty acids or as complex mixtures thereof as derived by the saponification of the oils and fats. A preferred fatty acid is tall oil fatty acid. Rosin acids that may be employed are the wood, gum, and tall oil rosin acids produced from pines. A preferred rosin acid is that derived from crude tall oil. A preferred tall oil product is a distillation product which is a mixture of fatty and rosin acids with a rosin acids content of from 18 to 36 percent by weight. The most preferred tall oil distillation product contains about 29 percent by weight rosin acids.

The alkylol amines which may be used include mono-, di-, and tri-alkylol amines derived from ammonolysis of ethylene oxide and/or propylene oxide. A preferred alkylol amine is triethanol amine.

Alkylene glycol coupling agents suitable for use are a 1,2-glycol derived from hydrolysis of an alkylene oxide such as ethylene, propylene, or butylene oxide, a 2,4-glycol such as hexylene (2-methyl-2,4-pentane diol) made by the reduction of acetylacetone, or a diol such as 1,4-butane diol made by reduction of maleic anhydride and its esters. A preferred alkylene glycol is hexylene glycol.

In terms of proportions the soluble oil concentrate usually contains a major amount (above 50 percent by weight) of either a paraffinic base oil or a naphthenic base oil, a substantial amount (between 3 and 15 percent by weight) of each of a mahogany sulfonate and fatty/-rosin acid, and a minor amount (between 0.5 and 3 percent by weight) of each of the remaining components including alkylol amine, alkylene glycol, and alkali metal hydroxide or its equivalent.

The oxazoline derivatives employed in the emulsifier systems and soluble oil concentrates of the invention have the generic formula:

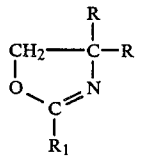

in which R is a straight or branched chain alcohol substituent having from 1 to about 10 carbon atoms and $R_1$ is a straight or branched chain fatty acid substituent having from 3 to about 20 carbon atoms.

The amides used have the following structure:

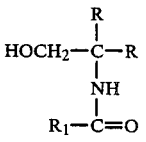

in which R is a straight or branched chain alcohol substituent having from 3 to about 20 carbon atoms and $R_1$ is a straight or branched chain fatty acid substituet having from 3 to about 20 carbon atoms.

The proportions of oxazoline derivative and amide vary from about 60 to about 68 percent by weight oxazoline and about 40 to about 32 percent by weight amide.

The ether sulfate ammonium salt surfactant has the general formula:

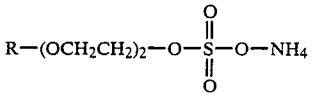

where R is a mixture of alkyl groups having 3 to about 20 carbon atoms.

Only a minor amount of the oxazoline derivative plus amide and ether sulfate ammonium salt are required for the soluble oil concentrations of the invention. Each additive may be present in amounts ranging from about 0.1 part by weight to about 4.0 parts by weight based on the weight of the soluble oil concentrate. More usually the additives are present in amounts varying between about 0.25 and about 2.0 parts by weight, however any amounts may be used which provide the desired synergistic effect.

The soluble oil concentrates of this invention are particularly suitable for forming stable emulsions comprising a minor amount of concentrate and a major part of water, which emulsions are especially useful as hydraulic fluids for mine roof jacks and the like. Usually the soluble oil concentrate is emulsified with between about 3 and about 60 parts by weight of water.

The following example is presented in illustration of the invention:

EXAMPLE

A Penreco Morco soluble oil base No. 6744 containing 40–70 weight percent sulfontes, 7–15 weight percent alkali, 7–15 weight percent alkyol amine, 15–35 weight percent carboxylic acids (fatty, rosin, naphthenic), and 1–5 weight percent alkylene glycol coupling agent was combined with a solvent refined 100 neutral paraffin base oil to form a soluble oil concentrate. This concentrate was tested without additives, with Alkaterge T-IV alone, Stepasol CA 207 alone and a combination of Alkaterge T-IV and Stepasol CA 207. Alkaterge T-IV is a combination of 60 to 68 weight percent of an oxazoline derivative having the formula previously set forth wherein R is hydroxymethyl, and $R_1$ is derived from oleic acid, and 32 to 40 weight percent of an amide having the formula previously set forth wherein R is 3 to about 20 carbon atoms and $R_1$ is 3 to about 20 carbon atoms. Alkaterge T-IV is a product of Angus Chemical Company. Stepasol CA 207 is a product of Stepan Chemical Company and is a 60 percent active ether sulfate ammonium salt having the formula previously reproduced in which R is 5.6 percent $C_6$, 43.4 percent $C_8$, 50.1 percent $C_{10}$, and 0.7 percent $C_{12}$ alkyl groups.

Each of the above described concentrates was poured onto a watch glass and left exposed to the atmosphere for 48 hours. Each sample was then examined for skin formation. Other samples of the concentrates were used to prepare emulsions by adding 5 parts of the oil concentrate to 95 parts of water containing 750 ppm hardness as calcium carbonate. Each of the emulsions was stirred for 4 minutes and then divided and transferred into a pair of small neck flasks containing 0.1 ml divisions and ground glass stoppers. The flasks were sealed and one of each pair was stored at ambient temperature and the other at 158° F. for 1 week, at which time the emulsions were examined and any separation noted and recorded.

In carrying out the rust test, cast iron chips were placed in a petri dish containing a filter paper and diluted with concentrates diluted to 3 and 5 weight percent with 100 ppm hardness water. The dish was covered and allowed to stand overnight. The amount of rust stain on the filter paper was an indication of the corrosion control provided by the concentrate.

The results of the test are presented in the Table.

TABLE

| | MORCO | | MORCO AND ALKATERGE | | MORCO AND STEPASOL | | MORCO AND ALKATERGE AND STEPASOL | |
|---|---|---|---|---|---|---|---|---|
| Paraffin Base Oil | 83.0 Wt % | | 82.5 Wt % | | 82.0 Wt % | | 81.5 Wt % | |
| Morco | 17.0 Wt % | | 17.0 Wt % | | 17.0 Wt % | | 17.0 Wt % | |
| Alkaterge | — | | 0.5 Wt % | | — | | 0.5 Wt % | |
| Stepasol | — | | | | 1.0 Wt % | | 1.0 Wt % | |
| Skin Test | Heavy | | No | | Medium | | No | |
| Rust Test | | | | | | | | |
| 3% Solution | Fail Moderate | | Fail Light | | Fail Light | | Pass* | |
| 5% Solution | Fail Light | | Pass* | | Fail Very Light | | Pass* | |
| Temperature, °F. | Amb | 158° | Amb | 158° | Amb | 158° | Amb | 158° |
| 750 ppm Separation Data | | | | | | | | |
| Oil | 0.3 | 3.2 | 0.4 | 2.5 | 1.8 | 1.0 | — | 0.5 |
| Oil Rich | 0.1 | 0.5 | — | 0.3 | 0.5 | 0.1 | 0.2 | — |
| Cream | — | — | — | — | — | — | — | — |
| Emulsion | 64.6 | — | 104.6 | 32.0 | 103.7 | 54.0 | 104.8 | 69.0 |
| Water | 40.0 | 94.75 | — | 70.0 | — | 50.0 | — | 35.0 |

*No visible rust stain

Reviewing the data, with no additives but the Morco, the formulation formed a heavy skin, failed both concentrations of rust test, and totally separated the soluble oil emulsion at the 158° F. level. When Alkaterge only was added at the 0.5% level, no skin was noted and the rust test passed one of the two tests. Thirty-two percent soluble oil emulsion was retained at 158° F. after one week. When Stepasol (1% level) was added by itself, the skin was medium, the rust test showed light rust, and 54% of the soluble oil emulsion was retained at 158° F. after one week. In the case where both Alkaterge and Stepasol were added, no skin was formed, both rust tests were passed, and the soluble oil emulsion retained at 158° F. was 69% after one week. The combination of Alkaterge and Stepasol clearly provides better results than either of the two additives by themselves.

We claim:

1. An emulsifier composition for soluble oil which comprises emulsifiers for soluble base oil in combination with an emulsion-stabilizing amount of (a) a mixture of an oxazoline derivative with straight or branched chain alcohol and fatty acid substituents and an amide with straight or branched chain alcohol and fatty acid substituents and (b) an ether sulfate ammonium salt surfactant containing a mixture of alkyl groups; wherein the oxazoline derivative has the formula

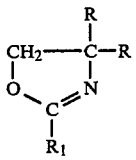

in which R is a straight or branched chain alcohol substituent having from 1 to about 10 carbon atoms and $R_1$ is a straight or branched chain fatty acid substituent having from 3 to about 20 carbon atoms; the amide has the formula

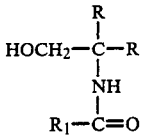

in which R is a straight or branched chain alcohol substituent having from 3 to 20 carbon atoms and $R_1$ is the same as in the oxazoline; and the ether sulfate ammonium salt has the formula:

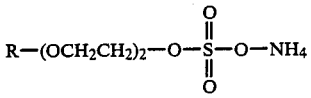

where R is a mixture of alkyl groups having 3 to about 20 carbon atoms.

2. A composition as described in claim 1 wherein each of ether sulfate ammonium salt and oxazoline plus amide are present at levels from about 0.1 to about 4.0 parts by weight based on the weight of the soluble oil concentrate.

3. A soluble oil concentrate comprising:

(a) a base oil, (b) emulsifiers, and (c) an emulsion-stabilizing amount of (i) a mixture of an oxazoline derivative with straight or branched chain alcohol and fatty acid substituents and an amide with straight or branched chain alcohol and fatty acid substituents and (ii) an ether sulfate ammonium salt surfactant containing a mixture of alkyl groups.

4. A concentrate as described in claim 3 wherein each of (i) and (ii) ranges from about 0.1 to about 4.0 weight percent, based on the weight of the soluble oil concentrate.

5. The concentrate of claim 3 in which the oxazoline derivative has the formula:

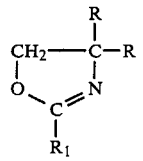

in which R is a straight or branched chain alcohol substituent having from 1 to about 10 carbon atoms and $R_1$ is a straight or branched chain fatty acid substituent having from 3 to about 20 carbon atoms;

the amide has the formula:

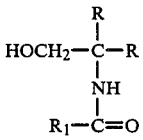

in which R is a straight or branched chain alcohol constituent having from 3 to 20 carbon atoms and $R_1$ is the same as in the oxazoline; and the ether sulfate ammonium salt has the formula:

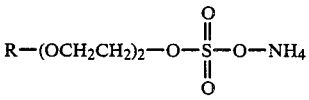

where R is a mixture of alkyl groups having 3 to about 20 carbon atoms.

6. The concentrate of claim 3 in which the base oil is a paraffin oil.

7. The concentrate of claim 3 in which the base oil is a naphthenic oil.

8. A soluble oil concentrate comprising:

(a) a paraffin base oil (b) an emulsifier mixture comprising an organic sulfonate, fatty and rosin acids, an alkali metal hydroxide, an alkylol amine and an alkylene glycol (c) an emulsion-stabilizing amount of (i) a mixture of an oxazoline derivative with straight or branched chain alcohol and fatty acid substituents and an amide with straight or branched chain alcohol and fatty acid substituents and (ii) an ether sulfate ammonium salt surfactant containing alkyl groups of 3 to about 20 carbon atoms wherein each of (i) and (ii) comprise from 0.1 to 4.0 percent by weight of the soluble base oil.

9. The concentrate of claim 8 in which the oxazoline derivative plus amide and the ether sulfate ammonium salt are present in amounts between about 0.25 and about 2.0 parts by weight based on the total soluble oil concentrate.

10. The concentrate of claim 9 in which the oxazoline derivative has the formula:

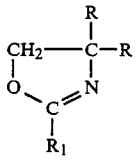

in which R is a straight or branched chain alcohol substituent having from about 1 to about 10 carbon atoms and $R_1$ is a straight or branched chain fatty acid substituent having from 3 to about 20 carbon atoms;

the amide has the formula:

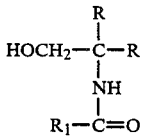

in which R is a straight or branched chain alcohol constituent having from 3 to about 20 carbon atoms and $R_1$ is the same as in the oxazoline; and the ether sulfate ammonium salt has the formula:

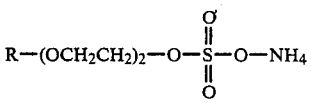

where R is a mixture of alkyl groups having 3 to about 20 carbon atoms.

* * * * *